United States Patent [19]

Edwards, Jr. et al.

[11] 4,168,415

[45] Sep. 18, 1979

[54] PRESSURE SWITCH HAVING MODULAR CONSTRUCTION

[75] Inventors: Stanley H. Edwards, Jr.; William D. Penland, both of Weaverville; James B. Warren, Skyland; Kenneth P. Roberts, Asheville, all of N.C.

[73] Assignee: Square D Company, Park Ridge, Ill.

[21] Appl. No.: 895,327

[22] Filed: Apr. 11, 1978

[51] Int. Cl.[2] ..... H01H 35/34

[52] U.S. Cl. ..... 200/308; 200/81 R; 200/83 SA; 200/83 J; 200/56 R; 340/626

[58] Field of Search ..... 340/611, 626; 200/81 R, 200/56 R, 308, 82 R, 83 A, 83 J, 83 R, 83 P, 83 S, 83 SA

[56] References Cited

U.S. PATENT DOCUMENTS 3,056,381 10/1962 Barnett ..... 200/83 SA 3,301,977 1/1967 Simonin, Jr. ..... 200/83 SA 3,447,390 6/1969 Good ..... 200/81 R

*Primary Examiner*—Gerald P. Tolin

*Attorney, Agent, or Firm*—William H. Schmeling; Richard T. Guttman

[57] ABSTRACT

An industrial type switch having modular parts which may be assembled so the switch may be used in a wide range of installations. The switch includes a differential module which is easily adjustable to operate over a selected range of pressures, a plug-in snap switch module so the switch may be easily wired and serviced, a range module so the response of the switch to pressures within a range may be readily accomplished, and any one of a plurality of different type actuator modules which are mountable on the exterior of the switch so the switch may be used in a large variety of different type installations.

13 Claims, 14 Drawing Figures

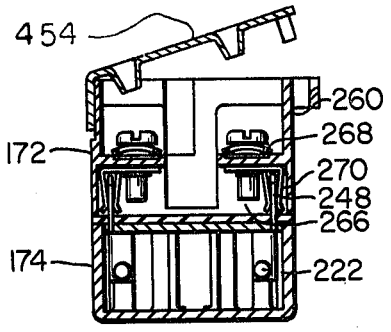
FIG. 9
FIG. 13
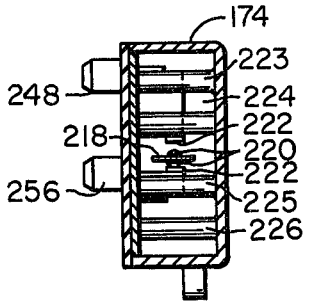
FIG. 14
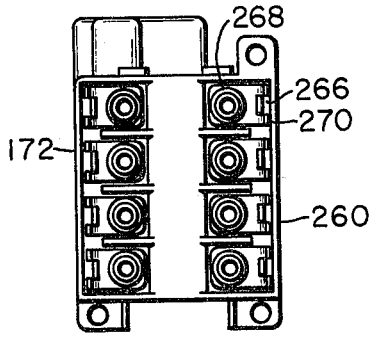

PRESSURE SWITCH HAVING MODULAR CONSTRUCTION

This invention relates to pressure actuated switching devices and more particularly to a device having modular components which are individually mountable in a pressure switch housing to satisify the requirements of a large number of different type pressure exerting systems with a minimum of different type components.

Pressure responsive devices of the type to which the present invention relates are conventionally known as industrial pressure switches and are used in industrial environments to detect and respond to pressure variations in a pneumatic or hydraulic system. The devices are constructed of components to be compatible with the requirements of the system in which they are used with the requirements of the components varying considerably because of the wide range of pressures and the wide range of different fluids present in the different systems. For example, the pressures may be either pneumatic or hydraulic. The pneumatic pressures may be developed by air or a corrosive or a non-corrosive gas. The hydraulic pressure may be provided by organic or inorganic fluids. Industrial pressure switches usually are provided with rugged housings usually of the die cast type which are sealed to isolate the pressure switch mechanisms from contaminants.

Heretofore the components of pressure switches have been formed into an integrated assembly which is mounted as a unit in a pressure switch housing. In the switch according to the present invention, the various components providing the different functions in the pressure switch are combined in individual modules which are individually mounted in the pressure switch housing so that the switch may be readily tailored to be used in a large number of different type systems with a minimum number of different components.

It is an object of the present invention to provide a pressure responsive switching device with modular components which are selected and individually mounted on a housing of the device so the device may be tailored to satisfy the requirements of a large variety of pressure producing systems with a minimum of different components.

A further object is to provide a pressure switch with a range module, which may be easily adjusted, so the switch will respond to a particular pressure within a range of pressures, a differential module, which is easy to adjust, so the switch will be actuated and de-actuated at two different pressures, a snap switch module which is easy to wire and replace and any one of a plurality of different type pressure responsive modules so the switch may be readily tailored to satisfy a large number of different pressurized systems.

Further objects and features of the invention will be readily apparent to those skilled in the art from the following specification and from the appended drawings illustrating certain preferred embodiments, in which:

FIG. 9 is a cross-sectional view taken along 9—9 in FIG. 1.

FIG. 13 is a cross-sectional view of the snap switch plug-in module in FIG. 8 as taken along line 13—13 in FIG. 8.

FIG. 14 is a rear view of the terminal block in FIG. 1.

Figure 1:
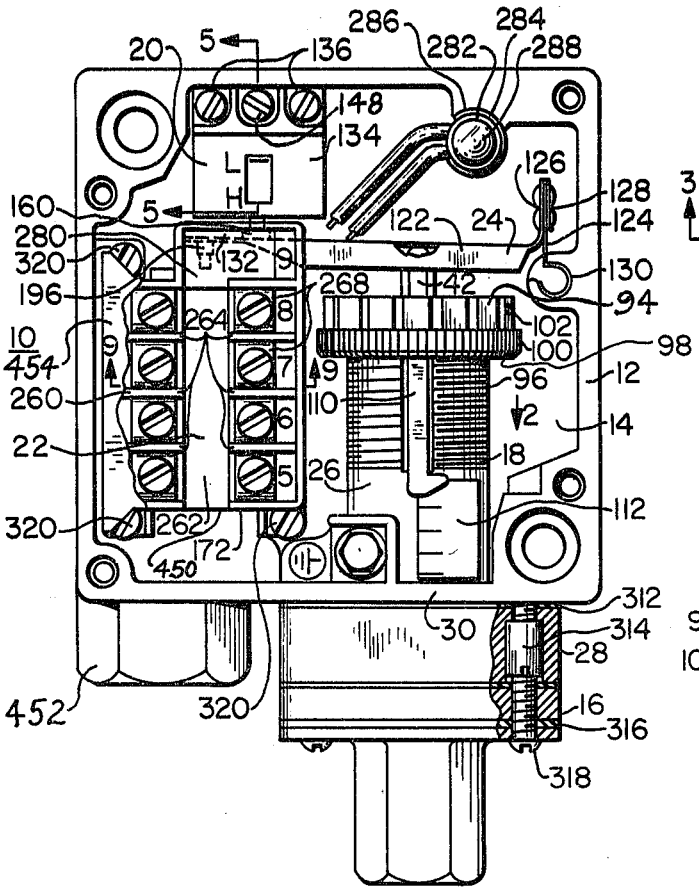
FIG. 1 is a front elevational view of a pressure responsive device embodying the features of the present invention with the cover of the device removed and a portion of the switch parts broken away.

Referring to the drawings, and particularly FIG. 1, a condition responsive device 10 is shown. The condition responsive device 10 is preferably of the industrial type pressure switch and includes a housing 12 having a hollow interior 14 extending from a front opening that is closed by a cover, not shown. Device 10 is formed from a plurality of individual modular assemblies that include pressure detecting module 16, a range selecting module 18, a differential pressure selecting module 20, a modular snap switch 22, and a lever assembly 24. Each of the modules is assembled from selected components which will permit the device 10 to be tailored to satisfy the requirements of a great number of different pressure producing systems. The housing 12 and a housing 26 of the range selecting module 18 are preferably formed of die cast metal with the housing 26 having a portion 28 mounted on a lower wall 30 of the housing 12 and a portion 32 extending through an opening in the wall 30 into the interior 14. A bore 34 extends through the housing 26 with the portion 28 having a counterbore 36 therein.

A rod assembly 38 is positioned in the bore 34 and the counterbore 36. The rod assembly 38 includes a rod 40, an adjusting screw 42 which is threaded into the upper end of the rod 40, a movable spring seat 44 which is secured on the lower end of the rod 40, a Belleville type washer 46 which has a central opening receiving a portion 50 on the spring seat 44, and a retaining ring 58 that is positioned between the outer peripheral edge of the Belleville washer 46 and an outer peripheral portion 60 of the spring seat 44. The rod assembly 38 is maintained in the bores 34 and 36 by a retaining ring 62. The retaining rings 58 and 62 are annular in shape and each includes an annular portion which is arranged to entrap the Belleville washer 46 between the rings 58 and 62 when the rings 58 and 62 are positioned in the counterbore 36. The rings 58 and 62 are keyed together against relative rotational movement and are positioned in the counterbore 36 by four arcuately shaped radially spaced lugs extending outwardly from outer surface portions of the retaining rings 58 and 62. The arcuate lugs 64 are arranged to pass through four radially spaced openings 66 that extend into the counterbore and are located between four inwardly turned arcuate flanges 68 so that the rod assembly 38 is positioned in the bores 34 and 36 when the retaining rings 58 and 62 are passed through the opening 66 and rotated so the arcuate lugs 64 are positioned between the flanges 68 and a surface 70 located at the upper end of the counterbore 36. When the rings 58 and 62 are thus positioned in the counterbore 36, the retaining ring 58 will provide a stop surface 72 at its upper side which is spaced from an inner stop surface 74 in the counterbore 36. The portion 60 on the spring seat is movable between the stop surfaces 72 and 74 with the range of movement of the spring seat 44 limited by the stop surfaces 72 and 74. The spring seat 44 has an upwardly extending inclined surface 76 extending between portions 50 and 60 which is slightly spaced over a greater portion of its length from the disked upper surface of the Belleville washer 46 when the portion 60 on the spring seat 44 is in engagement with the stop surface 72 and the Belleville washer 46 is in a stressed state. The spring seat 44 is constantly biased downwardly toward the position where the portion 60 engages the stop surface 72 by a compression spring 78 that is received in the bore 34 to surround the rod 40. The compression spring 78 has one end positioned on the surface 80 on the spring seat 44 and its other end positioned on a surface 82 that is located on a lock spring member 104 which is supported by a spring seat 84.

The upper spring seat 84 is generally annular in shape and movable in the upper end of the bore 34 and includes an annular downwardly facing flange 86 that surrounds a central opening in the spring seat 84. The flange 86 positions the upper end of the compression spring 78. The spring seat 84 is held against rotation in the bore 34 by a pair of oppositely extending lugs 88 that extend from the outer periphery of the spring seat 84 into elongated notches 90 that are formed in the walls at the upper end of the housing 26 so that the spring seat 84 is vertically movable in the bore 34 and limited in its movement in an upwardly direction when the lugs 88 engage the upper end surfaces 92 of the notches 90. The compression spring 78 constantly urges the lock springs 104 and spring seat 84 upwardly in the bore 34 to a position dictated by an adjusting nut 94.

The adjusting nut 94 is threaded on threads 96 that are formed on the outer surface of the housing 26 and extend downwardly from the upper end of the housing 26. The adjusting nut 94 has a lower surface 98 engaging the outer ends of lugs 88 and a finger gripping portion 100 as well as a modified castellated portion 102 on its outer periphery which may be used to rotate the nut 94 on the threaded portion 96 and cause the spring seat 84 to move downwardly in the bore 34 when the nut is moved in one direction and is move upwardly in the opposite direction when the nut is rotated in the opposite direction and thereby vary the force supplied by the compression spring 78 on the movable spring seat 44. The nut 94 is maintained in its adjusted position on the housing 26 by the lock spring member 104.

The lock spring member 104 has an annular portion 106 which is received in the bore 34 to surround the annular flange 86. Extending outwardly from one side of the annular portion 106 through the one of the notches 90 is a detent portion 108 that yieldably engages the finger portion 100 to restrain the nut 94 from rotation on the threads 96. Extending outwardly from the annular portion 106 through the other notch 90 is an indicating portion 110 that is L-shaped to provide an indicating portion that is disposed along the external surface of the housing 26 and terminates at its lower end in a pointer that is aligned with the markings on a suitable scale 112 to indicate the particular pressure setting of the device 10. The movement of the upper end of the rod 40 is guided by a guide 114.

Figure 2:
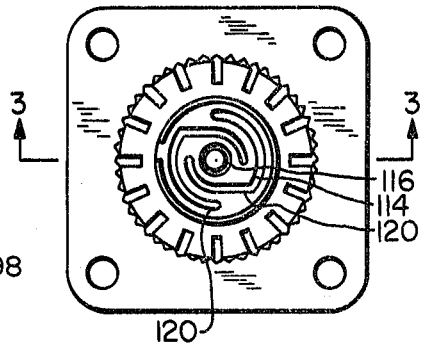
FIG. 2 is a top plan view of a range module as used in the device as taken in the direction of arrow 2 in FIG. 1.

Guide 114 is positioned at the upper end of the bore 34, as shown in FIG. 2, and includes a central opening 116 that receives the rod 40. The guide 114 is formed of relatively thin flexible metal material which is positioned on an annular surface 117 in the bore 34 by a C-shaped ring 118. The guide 114 is provided with a pair of convoluted slots 120 which permit the portion of the guide surrounding the opening 116 to flex with practically an axial movement and thereby guide the rod 40 with a minimum amount of friction as may be caused when the rod is tilted during its movement.

The lever assembly 24 includes a lever 122 and a pivot member 124. The lever is formed to have a channel shape with an upwardly extending ear portion 126 on one end. The pivot member 124 is formed of flexible metal material and pivots one end of the lever 122 on the housing 12 and includes a portion 128 that is secured by rivets to the ear portion 126. The pivot member 124 also includes a C-shaped portion 130 that is secured in a C-shaped opening extending from a wall of the housing 12. The lever 122 extends from its pivot as provided by the pivot member 124 to a free end 132 that is located in a space between the module 20 and the module 22. The pivot member 124 is stressed and positions the lever 122 in the interior 14 so a lower surface portion of the lever 122 located intermediate the pivot member 124 and the free end 132 engages the adjusting screw 42.

Figure 5:
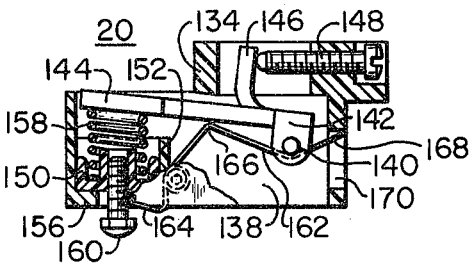
FIG. 5 is a view partly in cross-section of a differential pressure selecting module as taken along line 5—5 in FIG. 1.
Figure 4:
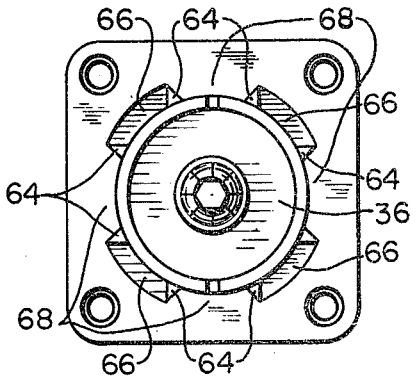
FIG. 4 is a bottom plan view of the range module shown in FIG. 3.

As shown in FIGS. 1 and 5, the differential pressure selecting module 20 includes a housing 134 that is mounted by a pair of screws 136 on the housing 12 at the upper end of the interior 14. The housing 134 is provided with an internal cavity 138. A pivot pin 140 extends between the walls of the cavity 138 and provides a pivot for one end of a differential lever 142 that has a spring seat 144 at its other end. The lever 142 has an upwardly extending ear 146 located intermediate its ends that is engaged by an adjustment screw 148. A movable spring seat 150 is maintained against rotation in a spring seat guide portion 152 of the housing 134. The spring seat 150 and the spring seat guide 152 are arranged so that the spring seat 150 may move vertically from a position where the spring seat 150 engages a bottom wall portion 156 on the housing 134 toward the lever 142. The compression spring 158 is positioned between the movable spring seat 150 and the spring seat 144. An adjusting nut 160 extends through an opening in the bottom wall 156 and is threaded into the spring seat 150. An indicator member 162 has an end portion 164 rigidly mounted on the housing 134. The indicating member 162 is formed of a resilient metal material and extends from the end portion 164 to an intermediate portion 166 that slidably engages a bottom surface portion of the lever 142 located intermediate the pivot pin 140 and the spring seat 144. The indicator member 162 has an end 168 remote from the end 164 movable in an opening 170 in the housing 134.

The modular snap switch 22 includes a terminal block assembly 172 and a snap switch assembly 174 which are electrically interconnected by plug-in connections. The snap switch assembly 174 includes a housing 176 formed of a molded insulating material to have an interior 178 extending from a rear wall 180 to an open front side of the interior 178. Extending forwardly from the rear wall 180 into the upper end of the interior 178 are a pair of spaced guide surfaces 182. Similarly extending forwardly from the rear wall 180 to the open end of the interior 178 at the lower end of the interior 178 are a pair of spaced guide surfaces 184. The guide surfaces 182 and 184 as well as portions of the rear wall 180 serve to guide the movement of a plunger assembly 186 in the interior 178. The movement of the plunger assembly 186 is also guided by portions of a cover 188 which provides a closure for the open side of the interior 178 and includes suitable openings which will be later described. The plunger assembly 186 includes a plunger 180, a movable contact assembly 192, a return spring 194, and an adjusting screw 196. Plunger 190 is formed of a suitably molded material and includes a portion 198 on one end that is positioned between the guide surface 182 and a portion 200 at its other end which is positioned between the guide surfaces 184. Portion 198 has a stop surface 204 formed thereon which is engageable with the lower end surfaces of the guide surfaces 182 to limit the movement of the plunger in an upward direction to a position where the upper surface of the plunger is flush with the upper surface of the housing 176. The return spring 194 is positioned between portion 200 and a lower surface of the housing 176 to constantly urge the plunger in an upward direction to the position where the stop surface 204 engages surfaces on the guide surfaces 182. The adjusting screw 196 is threaded into the upper end of the portion 198 and the snap switch assembly 174 is mounted in the interior 14 in a position where the upper end of the adjusting screw 196 engages a lower surface portion on the free end 132.

Figure 6:
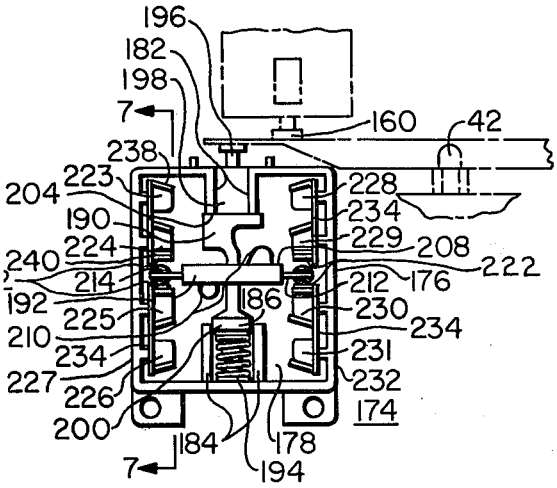
FIG. 6 is a plan view of a switching portion of one form of a snap switch module as used in the device in FIG. 1.
Figure 7:
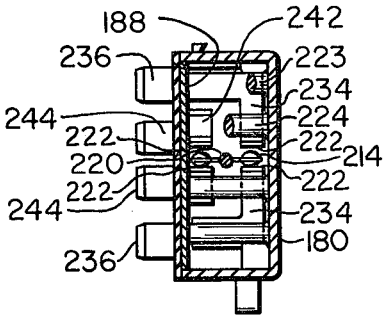
FIG. 7 is a view taken along line 7—7 in FIG. 6 showing certain parts in section.

Either of two types of movable contact assemblies 192 may be carried by the plunger 190. The two types of contact assemblies are respectively shown in FIGS. 6 and 8 wherein the arrangement shown in FIG. 6 will provide the switch with a double pole double throw contact action and the arrangement in FIG. 8 will provide the switch with a single pole double throw contact action. In the embodiments shown in FIGS. 6 and 7, a movable contact carrier 208 is formed of a suitable molded insulating material to have a rectangular shape and include a rectangularly shaped central opening which receives portions of the plunger 190. A pair of C-shaped strip-like spring members 210 reacting between surface portions on the plunger and end portions on the opening in the movable contact carrier 208 cause the movable contact carrier 208 to move upwardly in the interior 178 with a snap-like action when the plunger 190 is moved downwardly in the interior 178. Extending from opposite ends of the contact carrier 208 are molded projections 220 which position movable contacts 214 as shown in FIG. 7, so that the movable contacts 214 may bridge pairs of stationary contacts 216.

Figure 8:
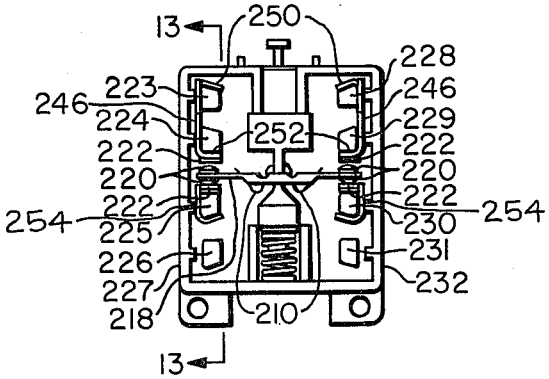
FIG. 8 is a front view of a terminal portion of one form of the snap switch plug-in module in FIG. 1.

In the embodiment shown in FIG. 8, a movable contact carrier 218 is formed of a suitable metallic material to have a channel-like shape and a rectangularly shaped central opening which receives portions of the plunger 190. A pair of C-shaped strip-like spring members 210 reacting between surface portions on the plunger and end portions of the central opening in the carrier 218 cause the movable contact carrier 218 to move upwardly in the interior 178 with a snap-like action when the plunger is moved downwardly in the interior 178. Secured on opposite ends of the carrier 218 are movable contacts 220 which are arranged to be moved into engagement with stationary contacts 222 to provide a bridging connection between the stationary contacts 222 when the carrier is moved upwardly from the position shown in FIG. 8.

Extending forwardly from the rear wall 180 adjacent each of the side walls of the housing are eight spaced posts that are spaced from their associated side wall. As shown in FIGS. 6 and 8, the posts 223–226 are located adjacent the left side wall 227 and the posts 228–231 are located adjacent the right side wall 232 of the housing. The posts 223–226 provide a support for and position terminal portions and stationary contacts of the switch 174 so that the switch 174 may be tailored to provide either a single pole double throw contact function or a double pole double throw contact function. In FIGS. 6 and 7, the components are arranged to provide a double pole double throw contact function. In FIG. 6, one of the stationary contacts 222 is positioned to face downwardly in the interior 178 adjacent the rear wall 180 and is carried on an L-shaped terminal member 234 that includes a portion that is positioned between the posts 223 and 224 and the wall 227 to extend from a portion carrying the stationary contacts to a terminal portion 236 that extends forwardly of the front surface of the housing 176. Terminal member 234 is maintained in its position between the posts 223 and 224 and the left side wall 227 by a portion 238 that is wrapped around a portion of the post 223 and a portion 240 which carries a stationary contact 222 and is wrapped around the portion of the post 224. The posts 228 and 229 similarly support a terminal member 234 which has a corresponding stationary contact 222 thereon that is located adjacent the rear wall 180 and arranged to face downwardly in the interior 178. As shown in FIG. 6, the posts 225 and 226, as well as posts 230 and 231, similarly position a terminal member 234 so that the associated stationary contact 222 faces upwardly in the interior in spaced relation to the contacts 222 which are carried by the terminal members associated with the posts 223–224 and posts 228–229. As shown in FIGS. 6 and 7, each of the posts 224, 225, 229, and 230 has a terminal member 242 positioned thereon which provides a support for a stationary contact 222 in the front portion of the interior 178 and includes a terminal portion 244. The terminal members 234 associated with the posts 224 and 223 are wrapped around their associated posts and arranged to position a stationary contact 222 so that the stationary contact faces downwardly at the rear portion of the housing in a manner particularly shown in FIG. 7. The posts 225 and 226 similarly support the terminal member 234 in a manner so that the stationary contact 222 associated therewith is located at the rear portion of the interior 178 and faces upwardly in the interior.

In FIG. 8, the components are arranged to provide a single pole double throw contact function. In FIG. 8, one of the stationary contacts 222 is positioned to face downwardly in the interior in a position intermediate the rear wall 180 on the front side of the housing 176 and is carried on an L-shaped terminal member 246 that includes a portion that is positioned between posts 223 and 224 and the wall 227 to extend from a portion carrying the stationary contact to a terminal portion 248 as shown in FIG. 13 that extends forwardly of the front surface of the housing 176. The terminal member 246 is maintained in position between the posts 223 and 224 and the left side wall 227 by a portion 250 that is wrapped around a portion of the post 223 and a portion 252 which carries a stationary contact 222 and is wrapped around a portion of the post 224. Posts 229 and 228 similarly support a terminal member 246 which has a corresponding stationary contact 222 that is located intermediate the rear wall 180 and the front side of the housing 176 and arranged to face downwardly in the interior 178. As shown in FIGS. 8 and 13, the posts 225 and the post 230 similarly position a terminal member 254 so that the associated stationary contact 222 faces upwardly in the interior in spaced relation to the contacts 222 which are carried by the terminal members associated with posts 224 and 229. As shown in FIGS. 8 and 13 the terminal member 254 provides a support for a stationary contact 222 and includes a terminal portion 256. The terminal members 254 associated with posts 225 and 230 are wrapped around associated posts and arranged to position a stationary contact 222 so that the contact faces upwardly in the interior 178 in a position intermediate the rear wall 180 and the front side of the housing 176.

As shown in FIGS. 6 and 7, the open front side of the housing 176 is closed by a cover 188. The cover 188 is provided with suitable openings which permit the terminal portions 236, 244, 248, and 256 to extend forwardly of the housing 176 and openings which receive front end portions of the posts 223–226 as well as posts 228–231. The front end of these posts is deformed as with heat to secure the cover 188 at the front side of the housing 176. The cover 188 has portions on its rear surface which act as a guide for the movement of the plunger 190.

The terminal block assembly 172 includes a housing 260, preferably formed of molded insulating material to have a shape generally conforming to shape of housing 176. The housing 260 has a front surface as shown in FIG. 1 that includes a centrally located recessed channel 262 that is provided to receive wire conductors that are connected to suitable terminals located on the front surface of the housing 260. Four spaced recesses extend rearwardly in the front surface of the housing 260 from each side of the channel 262. These recesses are defined by spaced ribs 264 that extend from the side walls of the housing 260 to the channel 262. The recesses are designated by numerals 1 through 8. As shown in FIGS. 13 and 14, located in the rear side of the housing 260 are spaced recesses 266 each of which is aligned with an individual recess 1 through 8 in the front surface and extending between each of the recesses 1 through 8 and its associated recess 266 is an opening which positions a terminal assembly 268. Each terminal assembly 268 includes terminal portion 270 that is secured in its associated opening, a wire clamp and a terminal screw located at the front side of the terminal housing and a female type plug-in electrical connector located in each of the recesses 266. The plug-in connectors are located to receive one of the terminal portions 236, 244, 248 and 256 when the terminal block assembly 172 and the snap switch assembly 174 are assembled to provide a plug-in connection therebetween. If desired, the housing 260 may be provided with an additional recess 280 that is formed by a portion of the housing 260 to overhang upper end of the housing 176. The additional recess 280 has a wire connecting terminal including a terminal screw and a wire connecting clamp therein which is used to connect a pilot light in circuit with a selected one of the stationary contacts 222 to indicate the operative condition of the device 10.

The pilot light as shown in FIG. 1 has a socket portion 284 that is received in a suitable socket receiving portion 286 that extends forwardly from the rear wall of the housing 12 and positions the pilot light 282 in the interior 14 so a bulb portion 288 of pilot light is visible through a suitably located opening in the cover for the device, not shown.

Figure 10:
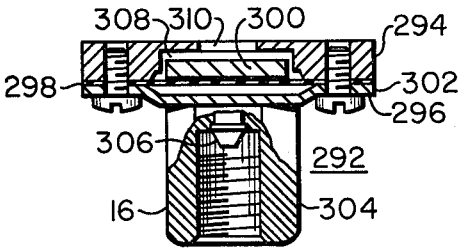
FIGS. 10 and 11 are cross-sectional views of two types of diaphragm actuator modules as may be used with the device in FIG. 1.

The device 10 may be tailored to operate over a large number of preselected pressure ranges and pressures, which may range from 0 to 12,000 psi, by furnishing the range module 18 with a Belleville washer 46 and a compression spring 78 that have preselected, predetermined characteristics and providing the device with a selected one of the three different type pressure detecting modules 16. A pressure detecting module 292 as shown in FIG. 10 is particularly suited for low and medium pressure systems and includes flange adapter 294 that is mounted on the lower surface of the portion 28 of the range module 18. Module 292 additionally includes a flange assembly 296, a diaphragm 298 and a pressure plate 300. Flange assembly 296 includes a mounting flange 302 which is secured to the lower surface of the flange adapter 294, a pipe connector 304 which is secured to the lower surface of the mounting flange 302, as by brazing, and a pulsation plug 306 which is secured in the upper end of the pipe connector. The pulsation plug has a bore of predetermined diameter extending therethrough to dampen the momentary pressure fluctuations to which the device 10 may be subjected. As shown in FIG. 10, the diaphragm 298, which is formed of flexible material, is sealingly secured between the flange adapter 294 and the mounting flange 302 and the pressure plate 300 is movable in a circular recess 308 that is formed in the flange adapter 294. The flange adapter 294 has an opening 310 extending from its upper surface into the circular recess.

Figure 11:
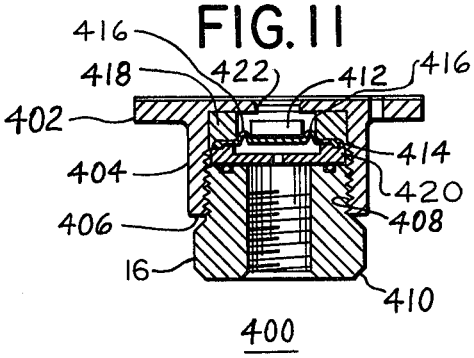

Turning now to FIG. 11, a second type 400 of the pressure detecting module 16 is shown. Module 400 is particularly suited for high pressure pneumatic systems or low pressure hydraulic systems and includes a flange adapter 402 that is mounted on the lower surface of the portion 28 of the range module 18. The adapter 402 includes a circular extension 404 having an open end 406 with internally threaded surface 408 for threadedly engaging a pipe connector 410. A pressure plate 412 rides on a diaphragm 414 which has a convolution 416 circumferentially around the pressure plate 412 so that the pressure plate 412 rolls upwardly on the diaphragm when pressure is applied. The diaphragm 414 is secured in the annular recess of the circular extension 404 by clamping guides 418 and 420 respectively. The adapter 402 includes an opening 422 for receiving the end 424 of spring seat 44. The pressure plate 412 is spaced from the opening 422 the same distance as the pressure plate 300 is spaced from the opening 310 of FIG. 10 so that both pressure plates 300 and 412 respectively engage the end 424 of the spring seat 44 in the same manner.

Figure 12:
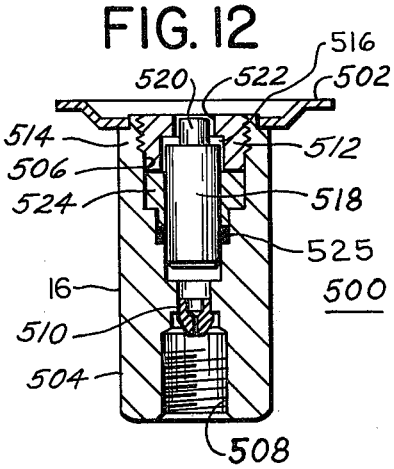
FIG. 12 is a cross-sectional view of a piston type actuator module as may be used with the device in FIG. 1.

Turning now to FIG. 12, a third type 500 of the pressure detecting module 16 is shown. Module 500 is particularly suited for low to very high pressure hydraulic systems and includes a dished flange adapter 502 that is mounted on the lower surface of the portion 28 of the range module 18. A cylinder 504 is secured to the lower surface of adapter 502, as by brazing, and a circular recess 506 in the cylinder 504 opens into the bottom of dished flange adapter 502. A second circular recess 508 in the cylinder 504 is connected to chamber 506 via a surge protection device 510. Recess 506 is threaded at its open end in the bottom of adapter 502 to receive an annular guide 512 which threadedly engages an upper portion 514 of the recess 506. The annular guide 512 includes an annular recess 516 for receiving a piston 518 having an extension 520 passing through an opening 522 in the guide 512 so that the extension 520 comes into contact with the end 424 of the spring seat 44. The upper extension 520 of the piston 518 is positioned in the opening 522 approximately the same distance from the end 424 of the spring seat 44 as pressure plates 300 and 412 of FIG. 10 and 11, respectively. The piston 418 bears against a bushing 524. To present hydraulic fluid from leaking between the bushing 524 and the piston 518 an elastomeric O-ring 525 is compressed between the sides of the piston 518 and the cylindrical recess 506 of cylinder 504.

With the three different types of pressure detecting modules 292, 400 and 500 as shown in FIGS. 10, 11, and 12 respectively, a wide range of industrial applications are possible for either pneumatic or hydraulic systems. Variations of pressure detecting modules 292, 400, and 500 by selecting various material for parts contacted by the pressure medium permits a wide variety of uses involving corrosive or non-corrosive fluid or gas pressure media.

While no particular sequence must be necessarily followed to assemble the components of the device 10 within the interior 14 of the housing 12, preferably the pressure detecting module 16, the range selecting module 18, the differential pressure selecting module 20, the modular snap switch 22, and the lever assembly 24 are individually assembled in the manner shown in the drawing and previously described. Initially the lever assembly 24 is installed in the interior 14 by positioning the C-shaped portion 130 in the slot in the housing where it is tightly held against rotation. The C-shaped portion is oriented in a manner so that the lever 122 extends slightly downwardly in the housing 12. Initially the portion 32 of the range selecting module 18 is passed through a suitable opening in the housing 12. The portion 28 of the range selecting module 18 is then secured by means of a seal 312 and suitable fasteners 314 to the lower surface of the housing 12. In the embodiment shown, four fasteners 314 are used, each extending through a suitable opening in the portion 28 to have a portion threaded into a threaded opening in the lower wall 30. As shown in FIG. 1, each of the fasteners 314 is provided with a threaded portion which is received in the threaded opening in wall 30 and a cylindrical portion which is received in a bore in the portion 28 to secure the portion 28 to the bottom wall 30 of the device 10. The pressure detecting module 16 is attached to the bottom wall of the portion 28 by a sealng gasket 316 and suitable screws 318 which are received in threaded recessed portions of the fasteners 314. In the embodiment shown, four fasteners 314 and four screws 318 are used to secure the pressure detecting module 16 and the range selecting module 18 to the housing 12. When the range selecting mdoule 18 is properly positioned in the interior 14, the adjusting screw 42 will engage the lower surface of the midportion of lever 122. The modular snap switch assembly 22, including the terminal block assembly 172 and the snap switch assembly 174 which are assembled to each other through a plug-in connection, is then installed in the interior 14 in a position wherein screws 320 extending through openings in the terminal block assembly 172 and the snap switch assembly 174 are threaded into bosses which extend from the rear wall of the housing 12. When the snap switch assembly 22 is thus positioned, the terminals associated with the numerals 1 through 8 will be readily accessible and the adjusting screw 196 will be in engagement with the lower surface of the free end of the lever 122.

The differential pressure selecting module 20 is secured in the housing by the screws 136 which are threaded into suitably located bosses which are internally threaded and extend along the upper wall of the housing 12. When the differential pressure selecting module 20 is thus secured within the housing 12, the adjustment screw 160 will then be in position to be engaged by the upper surface of the free end 132 on lever 122 when the free end rises.

A preferred procedure for adjusting the position of the nut 94, and screws 42, 148, 160 and 196 is as follows. With the plunger 190 depressed so the parts of the switch 22 are in a tripped position when the spring 194 is compressed, the screw 196 is adjusted so the free end 132 of lever 122 is at a predetermined position within the housing. The adjusting screw 42 of the range module 18 is rotated to a predetermined position so that as the spring seat 44 travels between stop surfaces 72 and 74, the lever 122 is pivoted and the free end 132 of lever 122 interacts with the snap switch assembly 174 in the following manner. As the free end 132 moves upwardly on rising pressure and before the spring seat 44 contacts stop surface 74, the snap switch resets. Now, as the lever end 132 moves downwardly on falling pressure and before the spring seat 44 contacts stop surface 72, the snap switch assembly 174 trips. By completing this sequence of adjustments of screws 196 and 42, the snap switch operates correctly relative to the movement of the spring seat 44 between the stop surfaces 72 and 74. Next, the range nut 94 is adjusted downwardly on threads 96 until the indicator 110 aligns with the pressure setting on scale 112 which is desired for switch operation on decreasing pressure. The pressure value at which the switch 10 operates on falling pressure is now determined and set as indicated on scale 112.

The pressure value at which the switch 10 operates on rising pressure is a value greater than that indicated on scale 112. The difference between operation on falling and rising pressures is referred to as the pressure differential. The value of the pressure differential is a function of the following two factors: (1) The inherent minimum differential which is a result of the inherent stroke and force differential of the snap switch 174; and (2) The compressive force in spring 158 which is determined by the position of the differential adjusting screw 148.

The switch 10 in the present invention is set to operate on a pressure value of rising pressure by adjusting screw 148 increasing or decreasing the compressive force on spring 158. By turning screw 148 counterclockwise which adjusts screw 148 inwardly and exerts a force on the ear 146 of the differential lever 142, the spring seat 144 on the opposing end of lever 142 stresses the compression spring 158. This compression force maintains the spring seat 150 against the bottom wall portion 156 on housing 134. Spring seat 156 will remain against wall 156 until an upward force that is greater than the compression force in spring 158 is applied upwardly against adjustment screw 160. Adjustment screw 160 is now adjusted to satisfy the following two conditions: (1) It is to be engaged by the free end 132 of lever 122 on the upward movement of end 132 before end 132 reaches the location on its upward travel that allows the snap switch 174 to reset (thus, the spring seat 150 is being lifted against the compressive force of spring 158 as lever 122 moves upwardly); and (2) The screw 160 is to be disengaged by the free end 132 of lever 122 on the downward movement of 132 before end 132 reaches the location on its downward travel that allows the snap switch 174 to trip (thus, that portion of the downward travel of lever 122 that results in the snap switch tripping is with the screw 160 disengaged from lever end 132).

Referring now to terminal block assembly 172 as shown in FIG. 1, the wire leads are laid in the trough 262 and attached to their respective terminal screws in the individual recesses 1–8. The wire leads extend out of the terminal block 172 at a bottom opening 450 and out of enclosure 12 through an electrical connector 452 which in turn is connected to a suitable conduit or flexible electrical cable. The open front side of the terminal block 172, as shown in FIG. 1, is closed by a cover 454. The cover 454 is provided with a snap fastener on the side opposite from the pivot point to securely fasten the cover to the terminal block enclosure. The cover 454 is provided with openings corresponding to the terminal screws in recesses 1–8 and are numbered accordingly to match the recesses 1–8. The openings on the cover are connected to funnel shape projections extending downwardly from the rear of the cover 454 so that an electrical probe can be stuck through the openings while the funnel shape of the projections on the back of the cover guide the electrical probe such as that of a voltage tester or the like to the proper terminal screw in the desired numbered recess. Therefore, maintenance personnel do not have to open the cover to check the terminals and this reduces a possible shock hazard.

Referring now to the operation of the pressure switch, the pressure detecting module 16 converts the pressure in the line of a machine tool or the like to a stroke motion via the pressure plate or piston in the module. The pressure plate acts against the lower spring seat 424 of the range selector module 18. The range selector module 18 incorporates a Belleville washer which serves two functional purposes. One is to act as a concentric bearing to hold the operating rod 40 in location while permitting a vertical motion transfer. The other is to serve as a spring with a negative spring rate. The Belleville washer is held in place by stops as previously described so that the Belleville washer only operates in the negative spring rate portion of its force stroke curve. The bottom and upper stops permit a stroke of approximatley twenty thousandths of an inch. The reason for operating the spring in the negative spring rate portion of its curve is for the sake of minimum differentials between operation of the switch on rising and falling pressures. The negative spring rate of the Belleville washer counteracts the positive spring rate of the range spring 78 and also the positive spring rate on the lever assembly 24 so that the net spring rate of the device 10 approaches zero. This reduces the minimum value of pressure differential to a value approaching the theoretical optimum. The operating rod engages the operating lever 122 and that transmits motion over to the snap switch module 22. The free end 132 of the lever 122 is holding down the snap switch screw 196. The snap switch screw is held down by the spring force of the hinged spring in the operating lever assembly 24. The switch 10 can be operated with or without the differential module 20.

Figure 3:
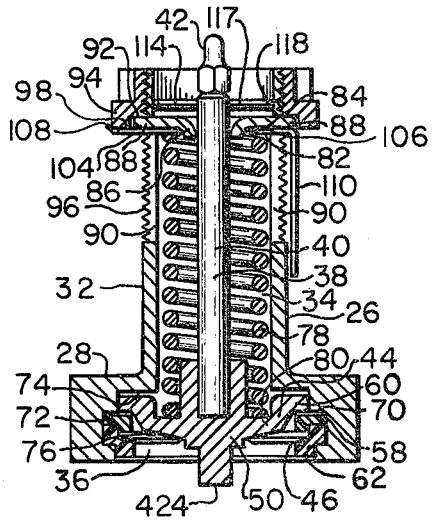
FIG. 3 is a cross-sectional view taken along line 3—3 in FIG. 2.

Referring back to the range module 18, the Belleville spring can either be orientated so that its force is aiding or opposing the range spring force. FIG. 3 illustrates the opposing mode of the Belleville washer. The reason for two different orientations of the Belleville washer are as follows: (1) In its illustrated position its force opposes the range spring force and aids the force from the pressure actuator module 16 so that the range settings can be dialed all the way down to zero PSI; and (2) If the Belleville spring is aiding the range spring and opposing pressure actuator 16 then the switch cannot be adjusted to a zero PSI. In short, the Belleville washer will contribute force to the push rod 40 upwardly in aiding the pressure actuating module 16 or will tend to deduct force from the push rod 40, thereby aiding the range spring instead of the pressure actuating module 16. In addition, the modular construction of the range modules 18 permits the range springs 78 to provide a variety of pressure ranges under which the pressure switch of the present invention can operate.

What is claimed is:

1. A pressure responsive device comprising: a housing having an enclosed interior, a modular pressure responsive detecting means externally mounted on the housing, said detecting means including an element that is moved from a predetermined position in response to variations in pressure detected by said detecting means, a modular range selecting means within the interior of the housing, said range selecting means including: a movable rod having an end engaging the detecting means element, spring means for constantly biasing the rod in a direction to resist movement of the detecting means element and a means for adjusting the bias of the spring means for preventing movement of the rod and element until the pressure detected by the detecting means exceeds a preselected amount, a lever having a portion engaging the end of the rod remote from the element, a modular differential selecting means mounted within the interior of the housing, said differential selecting means including a spring biased element engaging a portion of the lever and means for adjusting the bias exerted by the spring element and a snap switch module mounted within the housing, said snap switch module including a spring biased plunger engaging a portion of the lever and contacts movable by the plunger in response to movement of the plunger between two positions.

2. The device as recited in claim 1 wherein the detecting means is a selected one of a plurality of different modular pressure responsive detecting means that are mountable on the exterior of the housing with each of said plurality of pressure responsive detecting means including selected components which will cause each of said pressure detecting means to respond to a preselect range of pressure variations produced by a selected one of a plurality of pressure exerting media.

3. The pressure detecting device as recited in claim 1 wherein the means for biasing the rod in said direction includes a spring having a positive load deflection ratio reacting on the rod to resist the movement of the rod and element from the predetermined position and an element reacting on the rod to assist the movement of the rod and element from the predetermined range of movement from the predetermined position, said element having a negative spring rate throughout at least a portion of said range for causing said biasing means to exert a bias which will cause the work required to move the element in the detecting means and rod over the predetermined range to a minimum value.

4. The device as recited in claim 1 wherein the lever has a first end pivoted on the housing a second end remote from the pivoted end engaged by the spring biased element of the differential selecting means and the plunger of the snap switch module and a portion intermediate the first and the second ends engaging the rod.

5. The device as recited in claim 1 wherein the portion of the rod that is engaged by the lever includes an adjustment which will cause the lever to be at a predetermined position in the housing when the element in the pressure detecting means is at the predetermined position.

6. The device as recited in claim 5 wherein the element included in the differential selecting means includes a portion that is adjustable to position the differential selecting means element at a predetermined position when the lever is at the predetermined position.

7. The device as recited in claim 5 wherein the snap switch module includes a housing and the plunger is movable along a linear path in the housing and the portion of the plunger engaging the lever is adjustable so the plunger will be at a predetermined position in the snap switch housing when the lever is at the predetermined position.

8. The device as recited in claim 1 wherein the detecting means includes a diaphragm that has a first side engaged by the detecting means element and a second side exposed to and movable in response to variations in pressure of a pressure source for moving the detecting means element from the predetermined position.

9. The device as recited in claim 1 wherein the element in the detecting means is a piston movable in a cylinder in a housing for the detecting means with said cylinder having a first end engaged by the rod and a second end exposed to a pressure source for moving the piston from the predetermined position when the pressure of the source exceeds a preselected value.

10. The device as recited in claim 1 wherein the range selecting means includes a member having a first portion mounted on the exterior of the device housing and a second portion extending through an opening in the housing into the interior of the housing and a bore extending through the member including a counterbore in the first portion with the rod extending in the bore, a movable spring seat positioned in the counterbore and secured to a first end of the rod, means in the counterbore for limiting the movement of the spring seat in the counterbore, a second spring seat adjustably positioned in the bore, a compression spring surrounding the rod and having its opposite ends positioned on the movable spring seat and the second spring seat, said compression spring having a positive load deflection ratio and reacting on the spring seats to resist movement of the rod from the predetermined position, a Belleville type washer secured on the movable spring seat, said washer having a negative spring rate and positioned in the counterbore to exert a bias which will cause the work required to move the rod over a predetermined range to a minimum value, means including an adjustment member engaging portions of the second spring seat for adjustably positioning the second spring seat in the base and causing the compression spring to exert a predetermined bias on the first spring seat, and a member positioned in the bore to guide the end of the rod remote from the first spring seat during movement of the rod in the bore.

11. The device as recited in claim 6 wherein the differential selecting means includes means for indicating the bias exerted by the element.

12. The device as recited in claim 7 wherein the snap switch housing is divided into two housing parts with a first of said two housing parts having the plunger and stationary contacts of the snap switch positioned therein and the second of the two housing parts wire connecting terminal portions of the snap switch and the snap switch includes means providing plug-in connections between the terminals and stationary contacts.

13. The device as recited in claim 1 including a modular pilot lamp assembly positioned in the housing and wired in a circuit with contacts of the snap switch for indicating that the device has detected a predetermining pressure.

* * * * *